US006363946B1

(12) United States Patent
Sumner

(10) Patent No.: US 6,363,946 B1
(45) Date of Patent: Apr. 2, 2002

(54) LONGITUDINALLY ADJUSTABLE PERMANENT WAVE RODS

(76) Inventor: James W. Sumner, 2340 E. University Dr., #43, Tempe, AZ (US) 85281

( * ) Notice: Subject to any disclaimer, the term of this patent is extended or adjusted under 35 U.S.C. 154(b) by 0 days.

(21) Appl. No.: 09/569,130

(22) Filed: May 11, 2000

(51) Int. Cl.[7] ..... A45D 2/00; A45D 2/24
(52) U.S. Cl. ..... 132/265; 132/254; 132/245
(58) Field of Search ..... 132/265, 245, 132/254, 253, 262

(56) References Cited

U.S. PATENT DOCUMENTS

| | | | | | |
|---|---|---|---|---|---|
| 3,593,724 | A | * | 7/1971 | Leal | 132/265 |
| 3,683,940 | A | * | 8/1972 | Debue | 132/265 |
| 3,692,034 | A | * | 9/1972 | Stone | 132/245 |
| 3,713,455 | A | * | 1/1973 | Chen et al. | 132/245 |
| 3,937,233 | A | * | 2/1976 | Hook | 132/245 |
| 4,037,612 | A | * | 7/1977 | Ferrier | 132/245 |
| 4,135,525 | A | * | 1/1979 | Kriger | 132/265 |
| 4,361,159 | A | * | 11/1982 | Stefanik | 132/245 |
| 4,465,085 | A | | 8/1984 | Schopieray | |
| 4,524,788 | A | | 6/1985 | Pauldine | |
| 4,644,965 | A | | 2/1987 | Pauldine | |
| 4,699,160 | A | * | 10/1987 | Wiggin | 132/265 |
| 4,742,835 | A | | 5/1988 | Boweter | |
| 4,844,103 | A | | 7/1989 | Vick et al. | |
| 4,993,441 | A | | 2/1991 | Hanson | |
| 5,020,552 | A | * | 6/1991 | Hollenberg et al. | 132/265 |
| 5,144,968 | A | | 9/1992 | Rivera | |
| 5,201,329 | A | | 4/1993 | Quackenbush | |
| 5,622,193 | A | * | 4/1997 | Pekarik | 132/254 |

* cited by examiner

*Primary Examiner*—John J. Wilson
*Assistant Examiner*—Robyn Kieu Doan
(74) *Attorney, Agent, or Firm*—Schmeiser, Olsen & Watts

(57) ABSTRACT

A variety of longitudinally adjustable permanent wave rods are disclosed. Each permanent wave rod has an outer rod into which an inner rod fits. In one embodiment, an adjustable permanent wave rod has a number of sockets into which retainers fit. Alternatively, clips may be used to firmly hold hair between the clips and the inner and outer rods of the permanent wave rods. Preferably, the wave rods contain a distribution mechanism that distributes permanent solution towards the inside surface of the wave rods and also slows the solution down. Most preferably, the inner rod has a tapered surface along a substantial portion of its length and the outer rod has a tapered surface near the inner rod. Additionally, when the inner rod is tapered, a retractable ring is used that has extension couplings on it. The extension couplings are retracted beneath the outer surface of the outer rod when the inner rod is retracted and are fully extended and jut out from the outer surface of the outer rod when the inner rod is fully extended.

20 Claims, 12 Drawing Sheets

LONGITUDINALLY ADJUSTABLE PERMANENT WAVE RODS

BACKGROUND OF THE INVENTION

1. Technical Field

This invention generally relates to permanent wave rods and more specifically relates to longitudinally adjustable permanent wave rods.

2. Background Art

While there have been hair rollers that are longitudinally adjustable, these hair rollers cannot be used for permanent wave rods. Moreover, the permanent wave rods that currently exist have problems with the distribution of the permanent solution.

What is needed is a permanent wave rod that solves the problems of distribution of permanent solution while allowing longitudinal adjustments of the permanent wave rod.

SUMMARY OF THE INVENTION

According to the present invention, a longitudinally adjustable permanent wave rod is disclosed. The permanent wave rod may be adjusted longitudinally into two positions, although more positions may be added if desired. The permanent wave rod comprises two rods, an outer rod that receives an inner rod, where the inner rod is longitudinally movable relative to the outer rod. Because the outer rod has a larger width than the inner rod, the outer rod preferably has a tapered portion where the two rods meet. This tapered portion allows hair to transition between the two rods without creating "kinks" in the hair or catching the hair. Having the two rods at two different widths allows the large, outer rod to be used on hair near the scalp. This will provide a looser curl near the top of the head, but a tighter curl near the end of the hair. Alternatively, the inner, smaller width, rod may be used on hair near the scalp. This will provide a tighter curl near the scalp and a looser curl away from the scalp. Because the weight of hair will tend to lengthen curls that are near the head, having a tighter curl near the scalp will actually make the curls look more even.

The permanent wave rod of the current invention also preferably provides a distribution mechanism in the passages in each rod through which permanent solution is squirted. The distribution mechanism distributes permanent solution relatively evenly toward the inner surfaces of the rods, and prevents the solution from bypassing the drain holes nearest where the solution enters the reservoirs of the rods. The distribution mechanism also slows the permanent solution, which also helps distribution of solution. Furthermore, each rod's inner surface preferably has a number of depressions that more evenly distribute permanent solution throughout the permanent wave rod and to cause slow the solution's travel through the reservoir of the rod. This allows more solution to be retained for a longer time at the inner surface of the rods.

To provide longitudinal adjustability, some embodiments have engaging mechanisms on the inner rod that engage other engaging mechanisms on the outer rod. These cooperating engaging mechanisms can lock the two rods in a fixed longitudinal relationship. These cooperating engaging mechanisms preferably may be easily engaged and disengaged. Additionally, sockets that accept retainers are preferably provided on each rod. The retainers then hold hair tightly against the outer surfaces of the inner and outer rods. Alternatively, clips may be used that snugly fit around the rods and tightly hold the hair to the rods.

Finally, the most preferred embodiment of the present invention has a tapered inner rod and a retractable ring. The retractable ring's inner surface rides on the outer surface of the inner rod. The retractable ring has a number of coupling extensions that are attached to an O-ring of the retractable ring and that pass through openings in the outer rod. When the inner rod is fully retracted inside the outer rod, the retractable ring will be reduced in circumference, thereby retracting the coupling extensions beneath the outer surface of the outer rod. The benefit of retracting the coupling extensions is that there will be nothing on the outer rod that could cause kinked hair. When the inner rod is fully extended, the inner rod's outer surface will expand the retractable ring, thereby causing the coupling extensions to extend past the outer surface of the outer rod. The benefit of extending the coupling extensions is that sockets on each of the coupling extensions will now be able to be used, and this allows retainers to tightly hold hair to the outer surfaces of the rods.

The foregoing and other features and advantages of the invention will be apparent from the following more particular description of preferred embodiments of the invention, as illustrated in the accompanying drawings.

BRIEF DESCRIPTION OF DRAWINGS

The preferred embodiments of the present invention will hereinafter be described in conjunction with the appended drawings, where like designations denote like elements, and.

DETAILED DESCRIPTION OF THE PREFERRED EMBODIMENTS

Figure 1A:
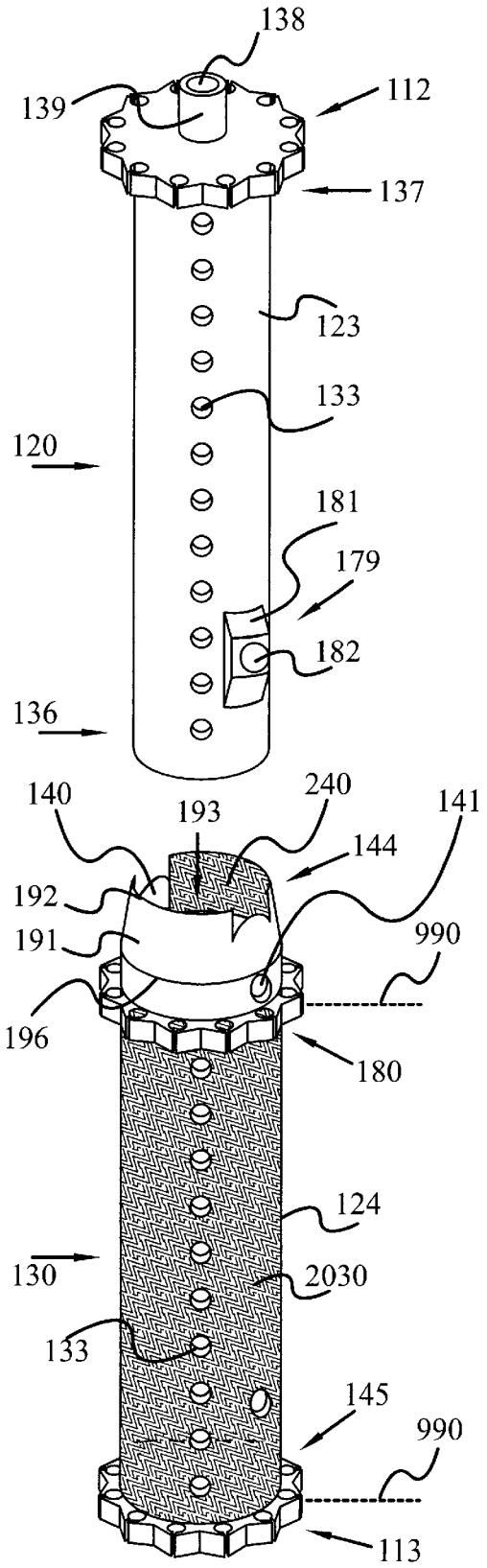
FIGS. 1–3 are illustrations of a preferred embodiment of a longitudinally adjustable permanent wave rod and retainers for use therewith.

A variety of longitudinally adjustable permanent wave rods are disclosed. Each permanent wave rod has an outer rod into which an inner rod fits. In one embodiment, an adjustable permanent wave rod has a number of sockets into which retainers fit. Alternatively, clips may be used to fly hold hair between the clips and the inner and outer rods of the permanent wave rods. Preferably, the wave rods contain a distribution mechanism that distributes permanent solution towards the inside surface of the wave rods and also slows the solution down. Most preferably, the inner rod has a tapered surface along a substantial portion of its length and the outer rod has a tapered surface near the inner rod. Additionally, when the inner rod is tapered, a retractable ring is used that has extension couplings on it. The extension couplings are retracted beneath the outer surface of the outer rod when the inner rod is retracted and are fully extended and jut out from the outer surface of the outer rod when the inner rod is fully extended.

Referring now to FIGS. 1 through 3 and FIG. 6, a longitudinally adjustable permanent wave rod 100 comprises retainers 101, 102, outer rod 130 and inner rod 120. Retainer 101 comprises a shaft 107, retainer balls 106, and an end 105. In the example of retainer 101, the ends 105 are triangular. Retainer 102 comprises shaft 108, retainer balls 109, and ends 2010. In the example of retainer 102, ends 2010 are cylindrical.

Outer rod 130 comprises integral end cap 113, a number of drain holes 133, a ring 180, a first engaging mechanism 141, tapered portion 191 having a first end 192 and a second end 196, an outer surface 124, a reservoir 193, an inner surface 201, a number of depressions 240, knurling 2030, tracks 140, an inner end 144, an outer end 145, and a bore 138 formed in tube 139. Inner rod 120 comprises an outer surface 123 second engaging mechanisms 179, drain holes 133, outer end 137, inner end 136, a bore 138 in tube 139, and integral end cap 112.

Figure 2:
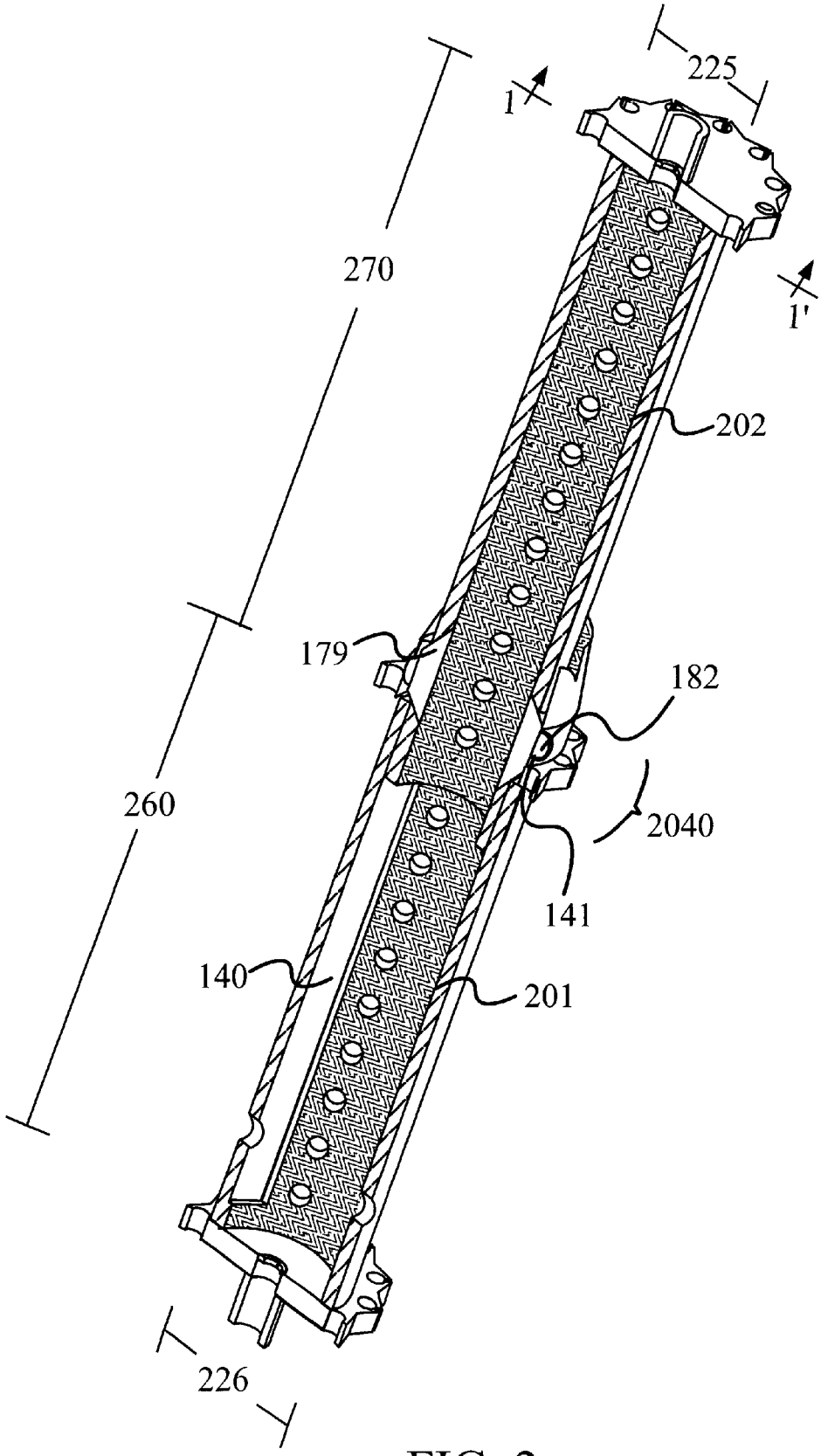
Figure 6:
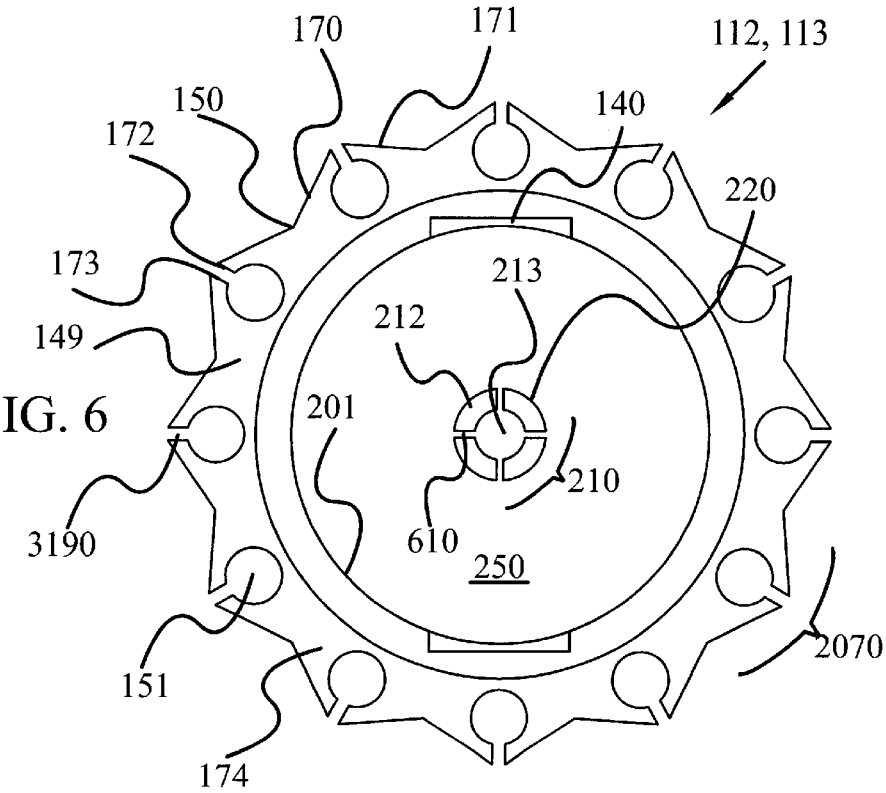
FIG. 6 is a cross-sectional view of a preferred embodiment of an end cap having a distribution mechanism.

FIG. 6 shows a view of an integral end cap along section 1–1' of FIG. 2. Integral end caps 112, 113 comprise a distribution mechanism 210 that is within passage 220, and a plurality of retention devices 2070 that are formed in integral end cap ring 149. Passage 220 is formed in body 250 of the integral end caps 112, 113. Each retention device 2070 comprises a socket 151 formed by a body 174. Body 174 also has sloped sides 170, 174 and top edges 172, 173. Valleys 150 separate each retention device 2070. Ring 180, formed proximate the inner end 144 of outer rod 130, preferably has a number of retention devices 2070 that also comprise a number of sockets 151. Distribution mechanism 210 most preferably comprises a deflection portion 213, openings 212, and bridges 610. Although sockets 151 are shown with a gap 3190 between top edges 172, 173, the sockets may also be completely circular and not contain the gap 3190.

Figure 3:
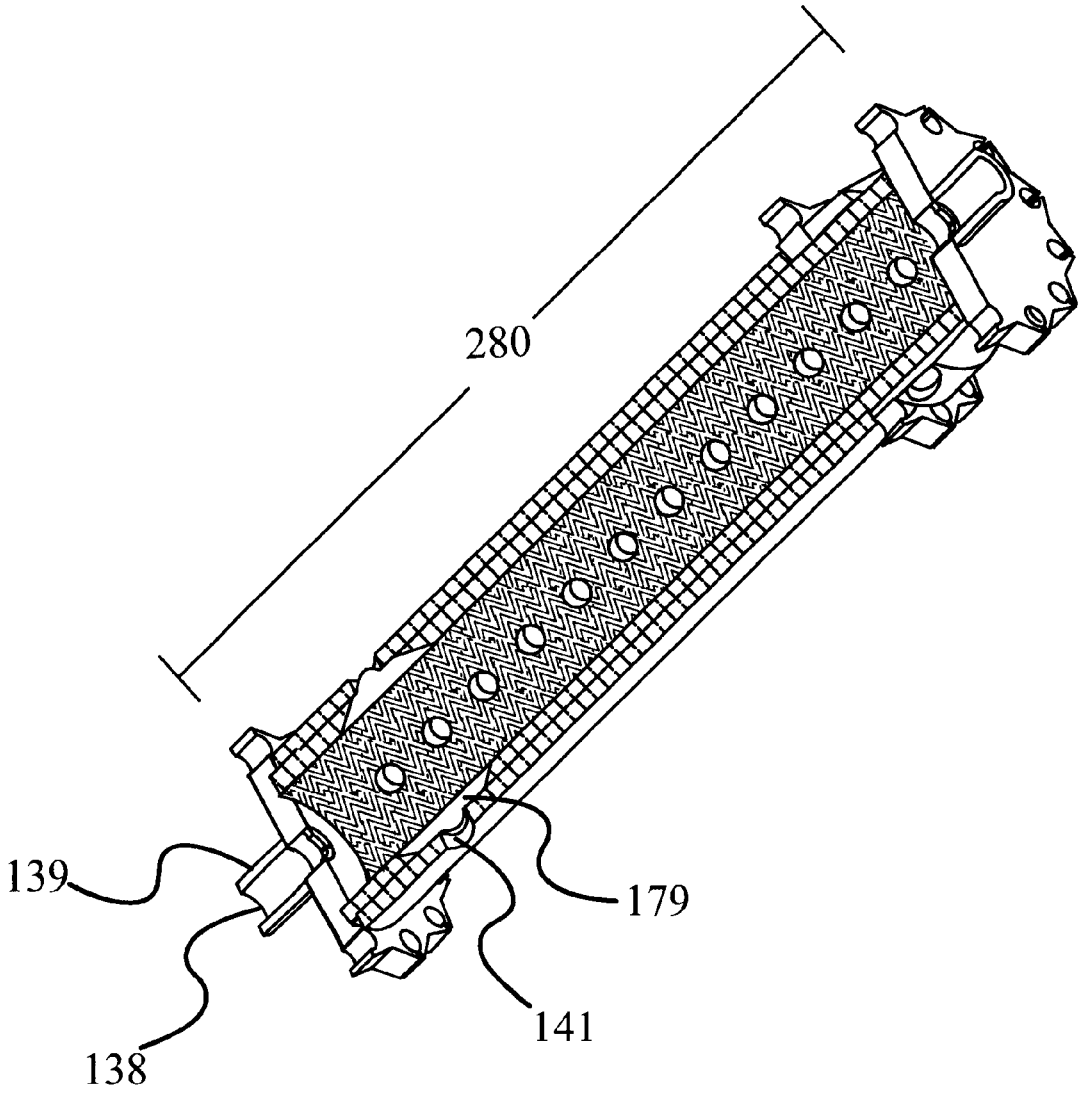

Second engaging mechanisms 179 in this example comprise engaging button 182 and body 181. In this particular example, second engaging mechanisms 179 are detent mechanisms. Engaging buttons 182 on the inner rod will engage first engaging mechanisms 141, which are receptacles in this example. In FIG. 2, second engaging mechanism 179 engages the first engaging mechanism 141 at inner end 144 of outer rod 130. In this particular example, the button 182 fills the receptacle 141 and fixes the relative position of the inner rod in relation to the outer rod. In this position, the inner rod is fully extended. In FIG. 3, second engaging mechanism 179 engages first engaging mechanism 141 at the outer end 145 of the outer rod 130. In this position, the inner rod is fully retracted. Although only two longitudinal positions for the inner rod are shown, there may be more or less positions.

Inner rod 120 and outer rod 130 are made of a substance that is resistant to permanent solutions and chemicals. Preferably, the rods are made of a harder plastic. Most preferably, the rods are made of mold injected polystyrene. Through the mold injecting process, the engaging mechanisms, distribution mechanisms, rings and their associated sockets, may be made integrally in the rod. It is preferred that the engaging buttons 182 and bodies 181 of the second engaging mechanisms be somewhat resilient. This is particularly true because each body 181 rides in a track 140, and the detent mechanisms 179 have to be somewhat compressed when the detent mechanism travels along the tracks 140, yet also have to spring into the receptacles 141. To create resiliency, the substance for the rods may be made slightly thinner at the detent mechanisms, if this is necessary.

The outer surface 124 of the outer rod 130 comprises a tapered portion 191 proximate the inner end 144 of the outer rod, the tapered portion 191 increasing in width from a first width at a first end 192 of the tapered portion 191 to a second and larger width at a second end 196 of the tapered portion, the first end 192 of the tapered portion proximate the inner end 144 of the outer rod, the second end 196 of the tapered portion distal the inner end 144 of the outer rod. The first end 192 of the tapered portion 191 preferably abuts the inner end 144 of the outer rod 130. The tapered portion and its preferable abutment of the inner end of the outer rod minimize the transition between the outer and inner rods. In this way, hair will not be kinked at this juncture. Because of the perming process, hair is being changed to enable it to curl. Without the tapered portion 191, there will be a potentially large difference in height (or width) between the outer surface 123 of the inner rod and the outer surface 124 of the outer rod. This difference in height can cause kinks in hair if the hair is tightly wrapped around the inner and outer rods. These kinks will be unsightly when the hair is permed. The tapered portion 191 on the outer rod minimizes or eliminates this effect.

Additionally, it is preferred that the ring 180 and its associated retention devices 2070 be as near as possible to the outer surface 124 of the outer rod 130 and yet still allow the retainers 101, 102 to contact the sockets 151 in the ring. Moreover, the valleys 150, sloped sides 170, 171, and top edges 172, 173 of the retention devices 2070 on ring 180 are preferably as rounded and smooth as possible. These features will limit the amount of kinks in the hair with the permanent wave rod 100 is being used with the inner rod 120 in an extended position.

Retainers 101, 102 are, in one embodiment, preferably made of a malleable and extensible material, such as rubber. This is particularly true for the embodiment where gap 3190 (see FIG. 6) is used in sockets 151. Additionally, the retainer material is preferably impervious or resistant to permanent chemicals. These retainers are generally placed such that balls 106, 109 are toward the middle of a rod, while the ends 2010, 105 are placed through sockets 151. This is indicated by lines 990 in FIG. 1. Triangular ends 105 are particularly beneficial when used in this manner, as the triangular ends may be pulled and thinned and then placed into the sockets 151. This allows the triangular ends 105 to fit very tightly into the sockets 151. If desired, the retainers 101, 102 may be pulled such that balls 106, 109 are on the outside of the sockets (away from the middle of a rod). The sockets 151 can contain a scalloped section to allow the balls to more tightly fit into sides of the socket, if desired. Currently existing end caps for prior art permanent wave rods have this type of scalloping. It is recommended that distances 270 and 260 be approximately the same so that differently sized retainers do not have to be made to fit these distances. On the other hand, distances 260, 270 can be somewhat dissimilar, as the retainers are preferably extendible enough to fit dissimilar sizes.

In a second embodiment, retainer 102 is preferably made of a flexible plastic. This is particularly true for the embodiment where gap 3190 (see FIG. 6) is not used in sockets 151, and the sockets are completely circular or cylindrical. The sockets in this case would be sized to be near the outer dimensions of ends 2010, such that the ends would tightly fit into the sockets. Additionally, the retainer material is preferably impervious or resistant to permanent chemicals.

It should be noted that it is preferred that the retainers hold hair tightly to the outer surfaces of the inner and outer rods. If this is not the case, then the permanent will not be tight and will potentially have an uneven appearance. Because of this, it is preferred that ring 180 be used. In this manner, one or more retainers may be used between the sockets 151 proximate the outer end 145 of the outer rod and the sockets 151 in ring 180. Additionally, one or more retainers may be used between the sockets 151 proximate the outer end 137 of the inner rod and the sockets 151 in ring 180. This will retain all the hair and tightly hold hair to both the inner and outer rods, when the inner rod is in its fully extended position. While the outer rod 130 could be made without ring 180, when the inner rod is in its fully extended position, there would have to be one retainer that fits between the sockets 151 proximate the outer end 145 of the outer rod and the sockets 151 proximate the outer end 137 of the inner rod. This retainer would not hold the hair tightly enough to provide an adequate perm. Additionally, multiple sizes of retainers would be needed to handle both the fully extended and fully retracted inner rod positions.

Drain holes 136 act to allow permanent solution in reservoirs 193, 2040 to pass from the reservoir to the outer surfaces 123, 124 of the outer and inner rods, respectively. Generally, each rod will have several rows of drain holes. Two rows of drain holes are shown in the figures, but more rows may be used. Additionally, drain holes do not have to be placed in rows. Recommended sizes for drain holes are between one-thirty-second of an inch and one-sixteen of an inch in diameter. Knurling 2030 is placed on outer surfaces 123, 124 to grip the hair better. Knurling outer surface of permanent wave rods is well known in the art.

Distribution mechanism 210 preferably has a number of openings 212. Most preferably, the distribution mechanism 210 is integrally formed through mold injected plastic with integral end caps 112, 113 (and removable end cap 750 in FIG. 7, to be discussed), although the distribution mechanism may be separate from the end caps. In the most preferred embodiment, there are a number of bridges 610 that connect deflection portion 213 with body 250 of integral end caps 112, 113. There could be more or less bridges, but four are shown in FIG. 6. The distribution mechanism 210 functions to slow permanent solution that is being squirted through bore 138 in integral end caps 112, 113 and to direct the solution relatively evenly toward the inner surfaces 201, 202 of the outer and inner rods, respectively. Any mechanism that performs these functions may be used as a distribution mechanism 210. For instance, a plate with holes laser drilled in it could perform a similar function; a sieve may also work. In prior art permanent wave rods, the solution tends to bypass the drain holes near the outer edges of the permanent wave rods and coalesce in the middle of the rods. This uneven solution distribution can, in tern, cause the hair wrapped around the outer surface of the rod to be permed unevenly. By using a distribution mechanism, the permanent solution is forced toward the inner surface of the rods and does not bypass the drain holes near the outer edges of the rods. There should be a relatively even amount of permanent solution at each drain hole.

Figure 7:
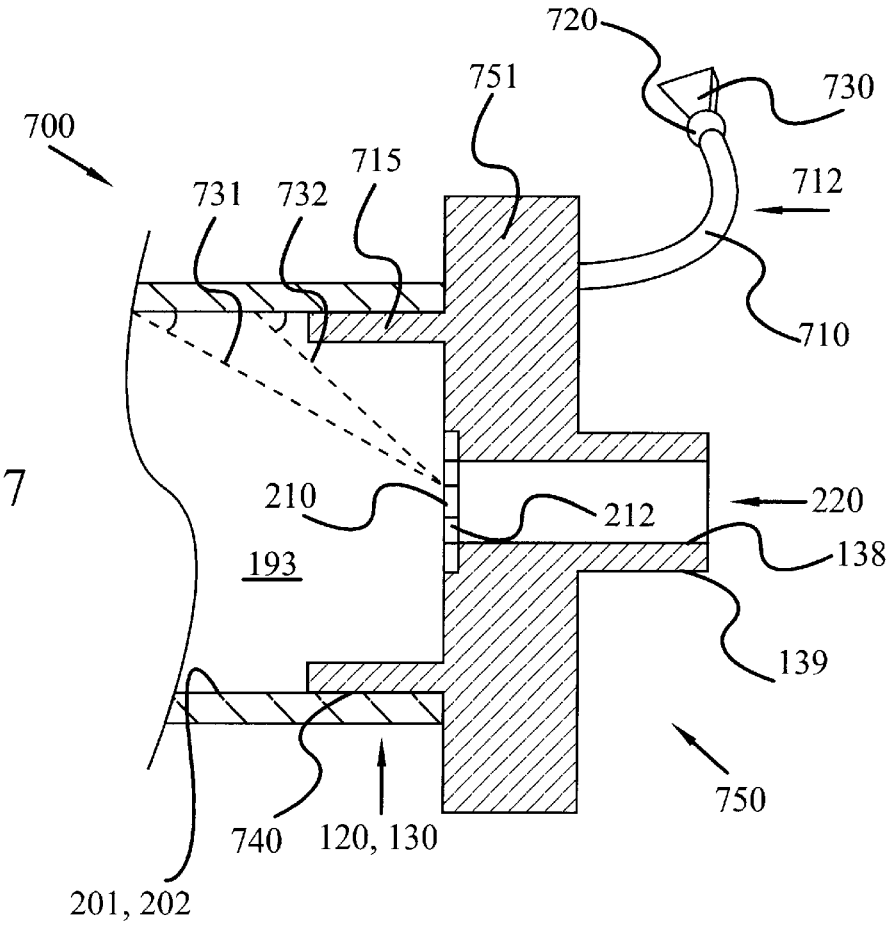
FIG. 7 is a cross-sectional view of a preferred embodiment of another end cap.

Turning briefly to FIG. 7, this figure shows two exemplary rays at which permanent solution, passing through one point of an opening 212, might be deflected by the distribution mechanism 210. As is known in the art, one measure of the wettability of a solid (which is the degree to which a solid may be wetted) is the contact angle between the solid and the liquid, as measured by the liquid, at a point where the surfaces of the liquid and the solid meet. In a prior art permanent wave rod, the permanent solution would be squirted through passage 220 and into reservoir 193. Most of the solution would contact inner surface 201 at a very high angle, relative to the inner surface. This angle would essentially be near 90 degrees for most of the solution, which means that the inner surface is relatively not wettable. This causes the solution to "ball up" and roll off the surface, which causes relatively ineffective and uneven solution distribution. In the present invention, however, the distribution mechanism 210 causes the solution to be distributed more towards the inner surface 201. Consequently, the permanent solution has angles of incidence that are generally much less than 90 degrees. This is indicated by exemplary rays 731 and 732. Thus, the inner surface 201 should be more wettable, and should distribute solution more readily than prior art permanent wave rods.

Returning to FIGS. 1 through 3 and 6, Depressions 240 also act to slow the progression of permanent solution and to more evenly distribute the solution. This should allow much more solution to stay at the inner surfaces 202, 201 of the inner and outer rods, respectively, and therefore allow more solution at the hair shaft and a more uniform curl pattern. In the example of FIG. 2, depressions 240 are shown as being relatively jagged and at an approximately 45 degree angle relative to cross-section line 1 to 1'. This angle is preferable, as it allows the solution to progress from distribution mechanism 210 to drain holes 136 that are distal the distribution mechanism, yet it also impedes the flow somewhat. If angles closer to the cross-section line 1–1' are used, the depressions will tend to limit the flow from the outer end 137 (for instance; the inner rod is similar) to the inner end 144 of the outer rod. If angles more perpendicular to the cross-section line 1–1' are used, the solution will tend to flow more quickly between the outer end 137 (for instance; the inner rod is similar) to the inner end 144 of the outer rod.

Figure 15:
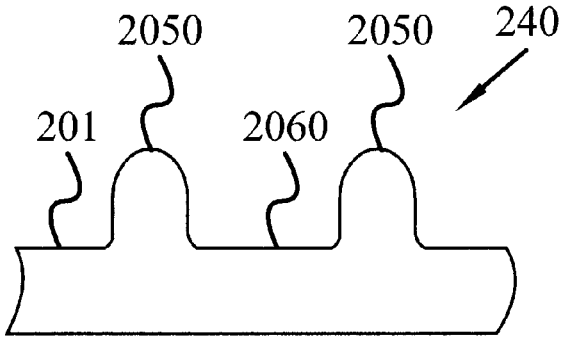

Ideally, each drain hole 136 would have the same amount of solution distributed to it. The depressions act to adhere the solution to the inner surfaces 201, 202, while also providing increased surface area and slowing the solution's progression through the rods. Referring now to FIGS. 12 through 15, FIGS. 12 through 14 show depressions that are made in the inner surface 201 of outer rod 130 (for example). Permanent solution can travel in these depressions and become more evenly dispersed. Alternatively, the depressions 240 may be made as shown in FIG. 15, where ridges 2050 surround a depression 260.

It should be noted that O-rings or other devices (not shown in FIGS. 1 through 3) may be used between the outer surface 123 of the inner end 136 of the inner rod 120 and the inner surface 201 of the inner end 144 of the outer rod 130 to provide a seal between the two rods and prevent solution from escaping at the junction between the two rods. In general, however, if the inner rod fits relatively snugly or tightly into the outer rod, there should be little or no leakage. This is particularly true because permanent solution is generally added at low pressures.

Figure 4:
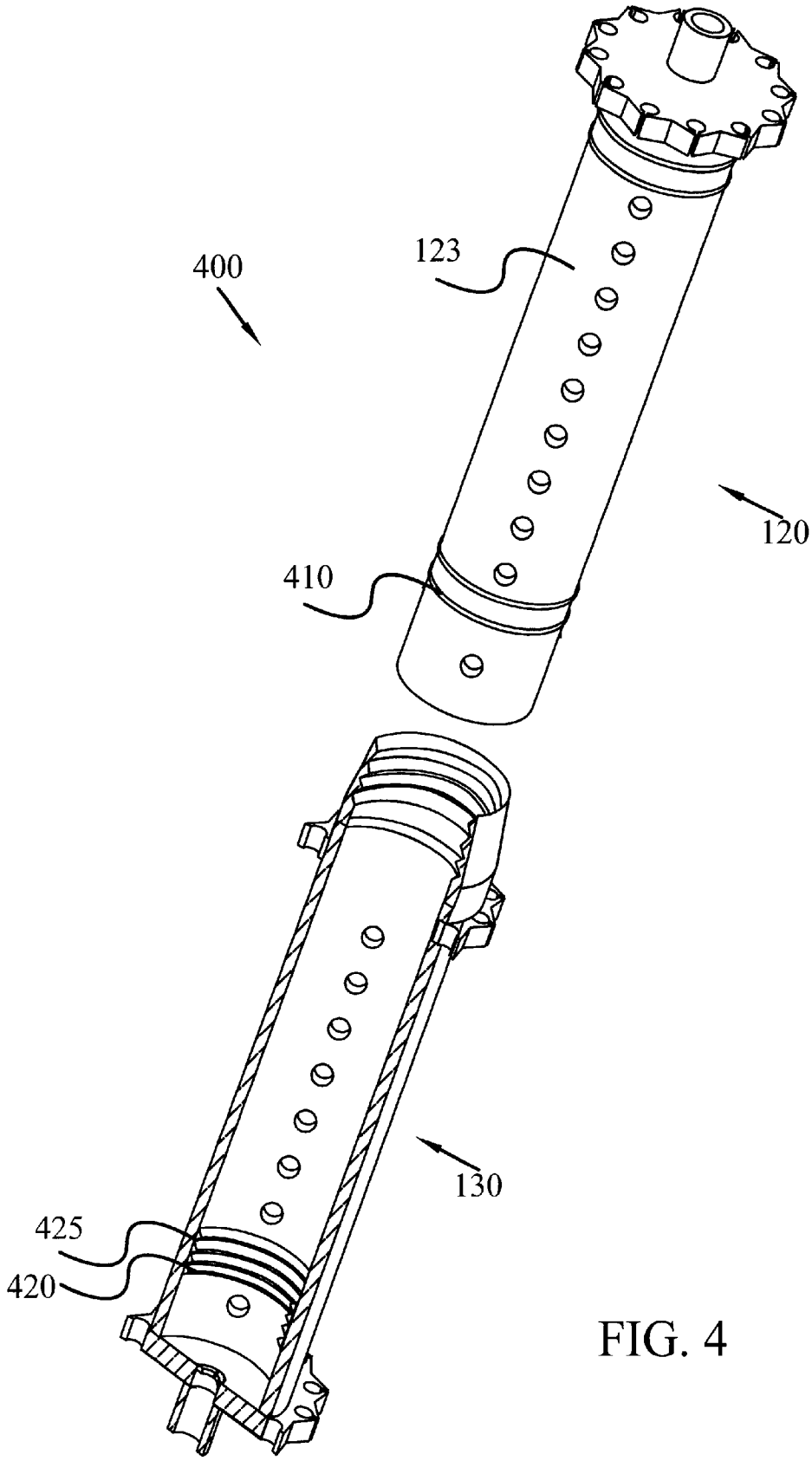
FIG. 4 is an illustration of another preferred embodiment of a longitudinally adjustable permanent wave rod in accordance with a preferred embodiment of the present invention.

First and second engaging mechanisms are any mechanisms that allow inner rod 120 to be fixed in longitudinal position relative to outer rod 130, yet also allow multiple longitudinal positions for the inner rod. The first and second engaging mechanisms cooperate to fix the longitudinal relationship or location of the inner and outer rods. Turning now to FIG. 4, a second preferred permanent wave rod 400 is shown that has different first and second engaging mechanisms. In this example, the first engaging mechanisms are grooves 420 separated by ridges 425. The second engaging mechanisms are O-rings 410 that are preferably in grooves (not shown) in the outer surface 123 of the inner rod 120. O-rings 410 fit into grooves 420. This fixes the inner rod 120 in longitudinal relationship to outer rod 130, and the O-rings and grooves 420 cooperate to fix this longitudinal relationship. Additionally, the O-rings and grooves provide a seal between the two rods. Although FIG. 4 shows that the inner rod 120 may only be adjusted in two longitudinal positions, additional O-rings 410 and grooves 420 may be added to increase the longitudinal positions.

Figure 5:
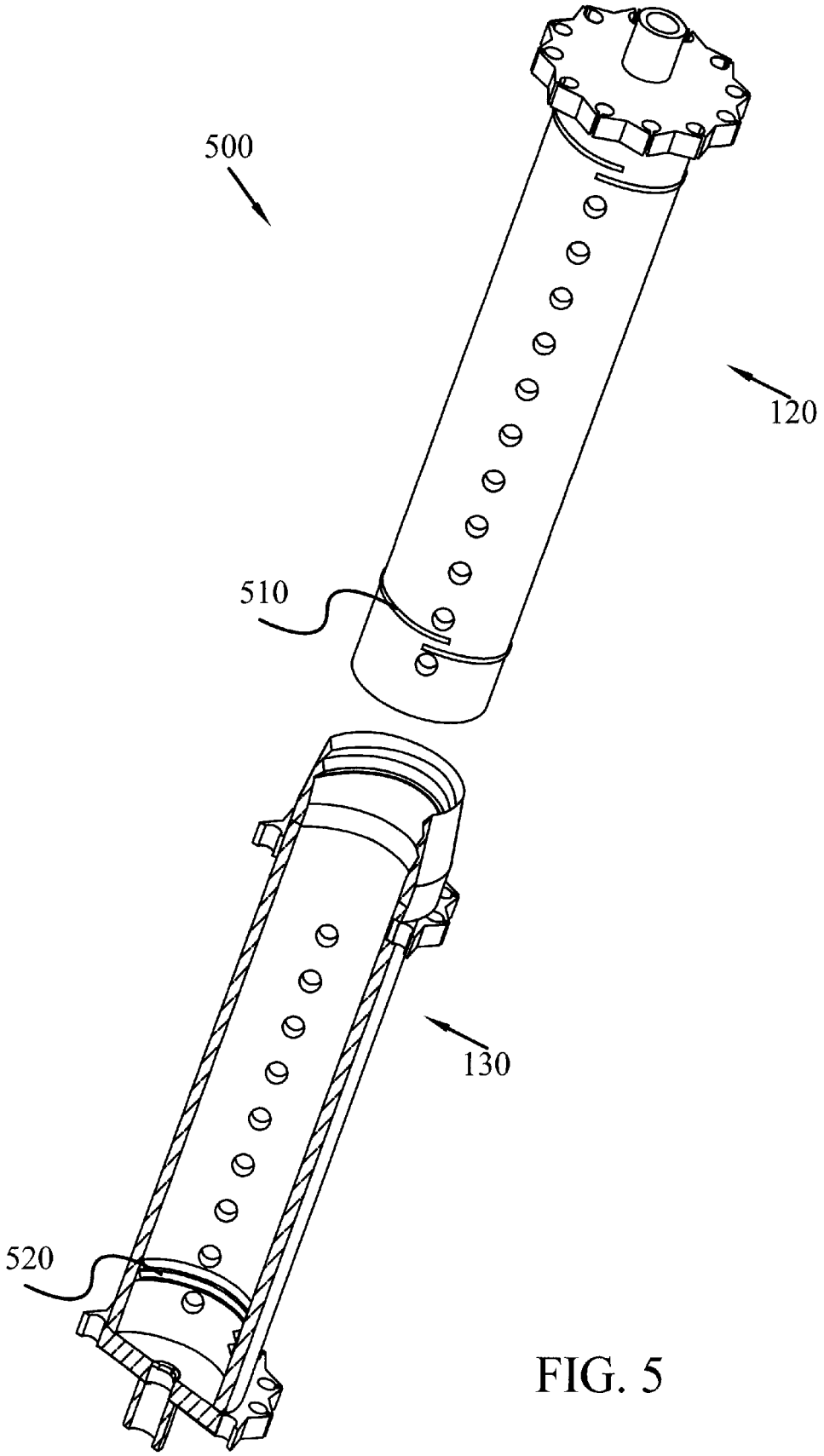
FIG. 5 is an illustration of another preferred embodiment of a longitudinally adjustable permanent wave rod in accordance with a preferred embodiment of the present invention.

Turning now to FIG. 5, this figure shows another preferred permanent wave rod 500 that uses different first and second engaging mechanisms. Again, the first and second engaging mechanisms that cooperate to fix the longitudinal relationship and position of the inner and outer rods. In this example, the first engaging mechanisms are female threads 520 and the second engaging mechanisms are male threads 510. The male threads cooperate with the female threads when the inner rod 120 is rotated. Turning the rod clockwise or counter-clockwise a large enough distance will allow the male threads to completely pass through and break free of the female threads. Again, the inner rod can be fixed in a fully extended and a fully retracted position, but more positions may be added by adding cooperating male and female threads. Note also that the female threads could be placed on inner rod 120, while the male threads could be on outer rod 130.

Figure 1B:
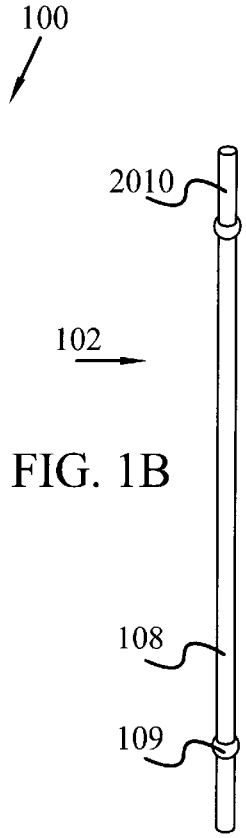
Figure 1C:
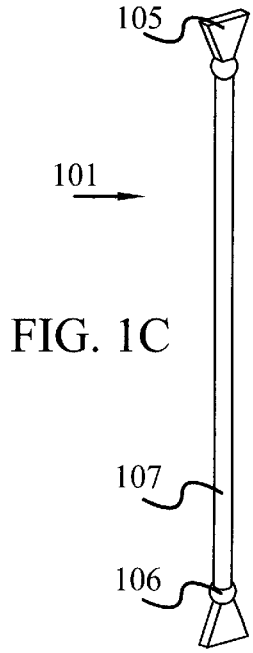

Turning to FIGS. 1 and 7, FIG. 7 shows an outer rod portion 700 into which a removable end cap 750 is adapted to snugly fit. It is expected that removable end cap 750 could also be adapted to snugly fit into inner rod 120. Removable end cap 750 preferably comprises a body 751 that preferably has distribution mechanism 210, as previously described, a bore 138 formed in or by tube 139, and insert 715 having outer surface 740. Attached to body 751 is a retainer 712, which comprises a shaft 710 a retainer ball 720, and an end 730 (in this example, end 730 is shown as being triangular). Retainer 712 is similar to retainers 101, 102 as previously discussed in FIG. 1. Retainer 712 could be permanently attached to body 751, through any manner known to those skilled in the art, or could be made removably attached to body 751 through such means as a ball (on the shaft 730) and socket (on the body 751) means. If a removable end cap is used on outer rod 130, an integral end cap may be used on inner rod 120, or vice versa. Moreover, both the outer and inner rods may have removable end caps.

The outer surface 740 of insert 715 preferably snugly meets the inner surface 201 of the outer rod 130. The removable end cap 750 will thus provide a seal that is tight enough to prevent permanent solution from leaking from the reservoir 193 of the outer rod past outer surface 740 and to the outside of the rod.

Figure 8A:
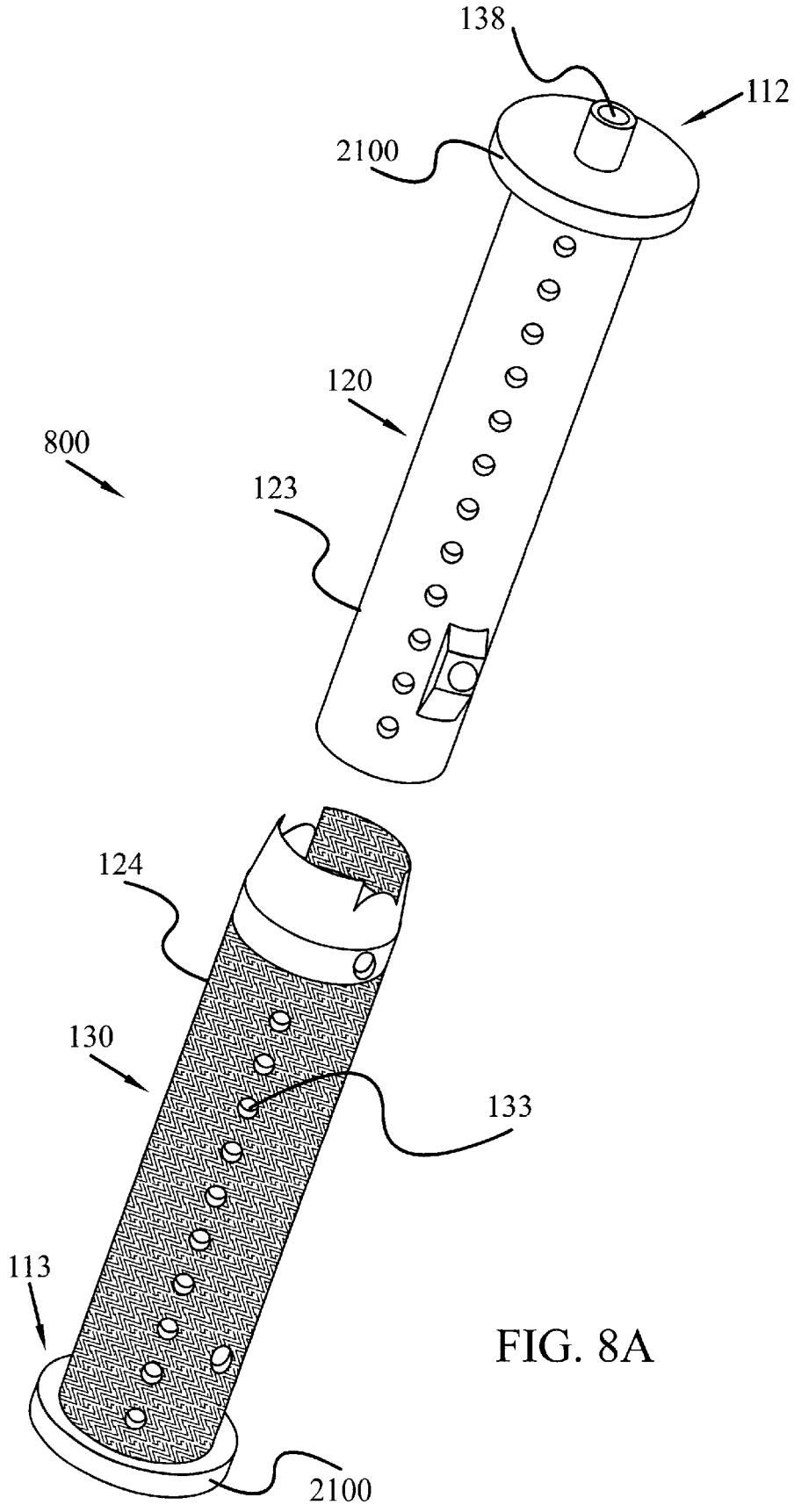
FIG. 8 is an illustration of another preferred embodiment of a longitudinally adjustable permanent wave rod in accordance with a preferred embodiment of the present invention.
Figure 8B:
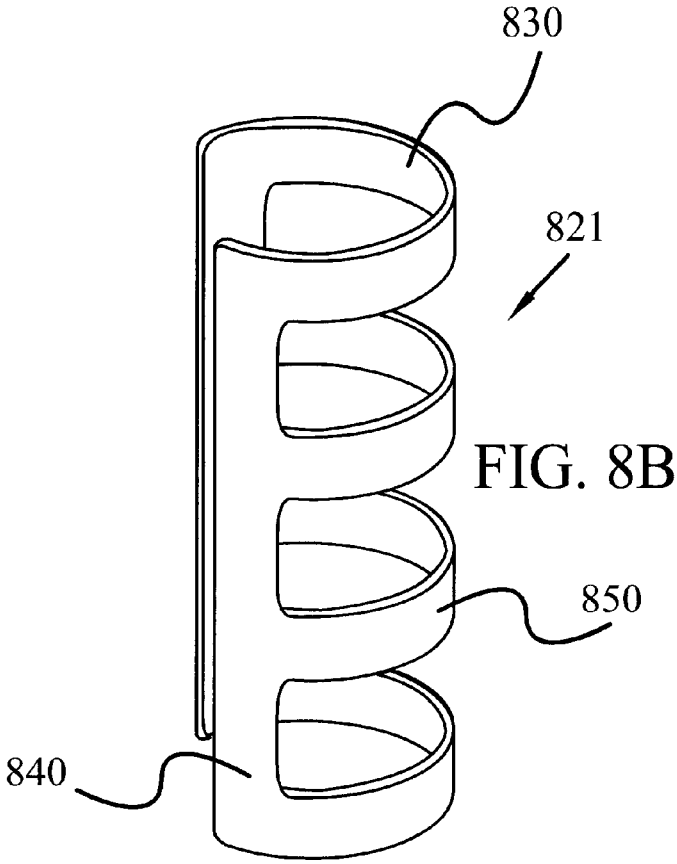
Figure 8C:
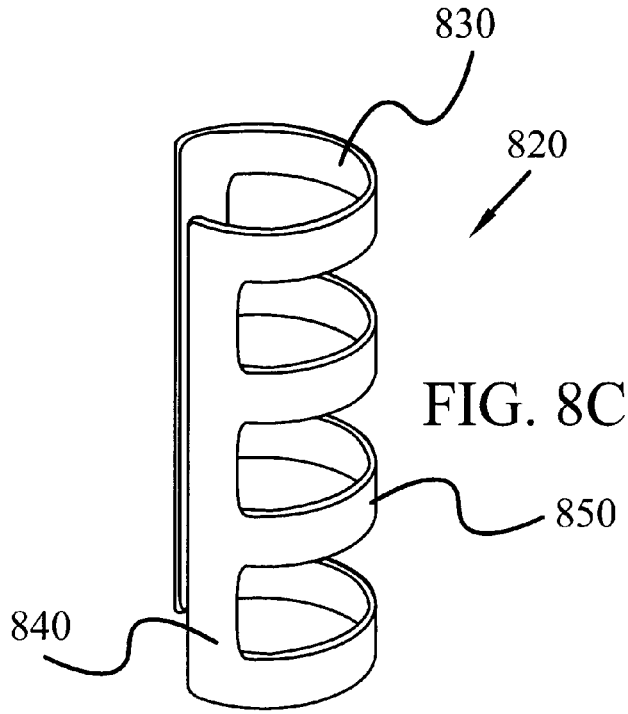

Referring now to FIG. 8, this figure shows yet another preferred permanent wave rod. In this embodiment, permanent wave rod 800 again comprises inner rod 120 and outer rod 130, which are similar to the permanent wave rods already discussed. Therefore, only the differences between permanent wave rod 800 and the previous permanent wave rods will be discussed. Inner rod 120 and outer rod 130 still most preferably comprise integral end caps 112 and 113, respectively. Preferably, these end caps comprise a raised, oval area 2100 that is useful when rolling hair on the outer surfaces 123, 124 of the inner and outer rods, respectively.

The permanent wave rod 800 preferably comprises clips 820, 821 which are used as retainers to tightly press hair (not shown) to the outer surfaces 123, 124 of the inner and outer rods, respectively. Clips 820, 821 preferably comprise a convex surface that is adapted to contact the hair and to snugly fit the outer surfaces 123, 124 of the inner and outer rods. Most preferably, clip 821 will be slightly larger than clip 820 to allow for the larger diameter of outer rod 130, as compared to inner rod 120. Turning briefly to FIG. 2, it can be seen that diameter 226 of the outer surface 124 of outer rod 130 is larger than diameter 225 of the outer surface 123 of inner rod 123. Returning to FIG. 8, because of this diameter difference between the rods, convex surface 830 of clip 821 is preferably made with a larger radius than is convex surface 830 of clip 820. However, clips 820, 821 can be made the same size if their material is somewhat flexible. Most preferably, the material for clips 820, 821 will be made from a plastic that is impervious to permanent solutions. Generally, plastics will have some flexibility.

Clips 820, 821 preferably comprise bars 840 that interconnect ribs 850. It is also possible to make clips 820, 821 without ribs and bars, as one relatively thin piece of plastic that is penannularly cylindrical. Nonetheless, ribs and bars should allow more flexibility and allow the hair underneath the clips to be seen.

It should be noted that the permanent wave rod of FIG. 8 may also be used as a curling rod. In this embodiment, steam could be coupled to bore 138 and passed into the cavities of the inner and outer rods. Drain holes 133 could be made quite small (preferably less than one-thirty-second of an inch in diameter), and the steam would infiltrate the hair through the drain holes.

Figure 9:
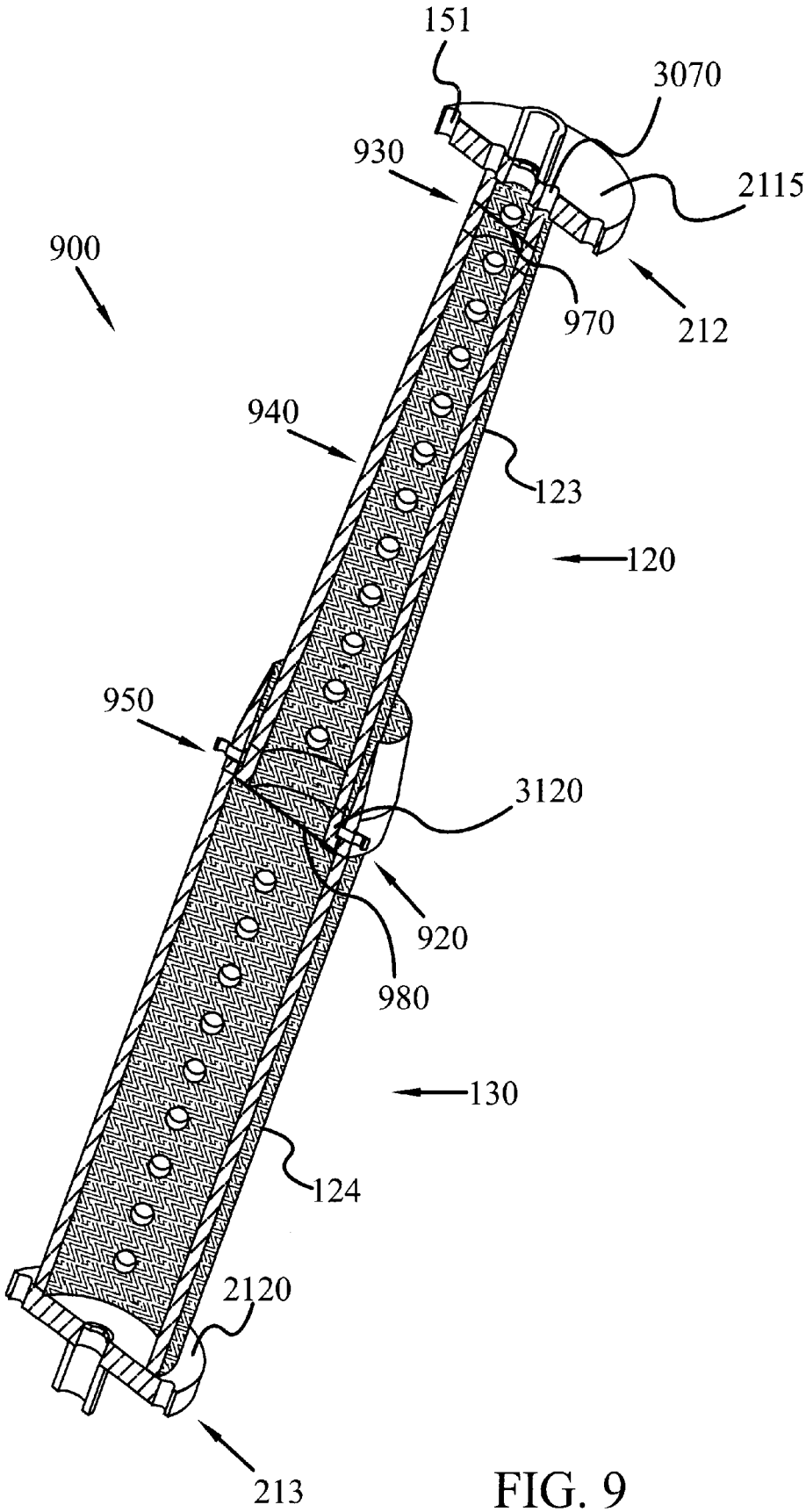
FIGS. 9 and 10 are illustrations of the most preferred embodiment of a longitudinally adjustable permanent wave rod.
Figure 10:
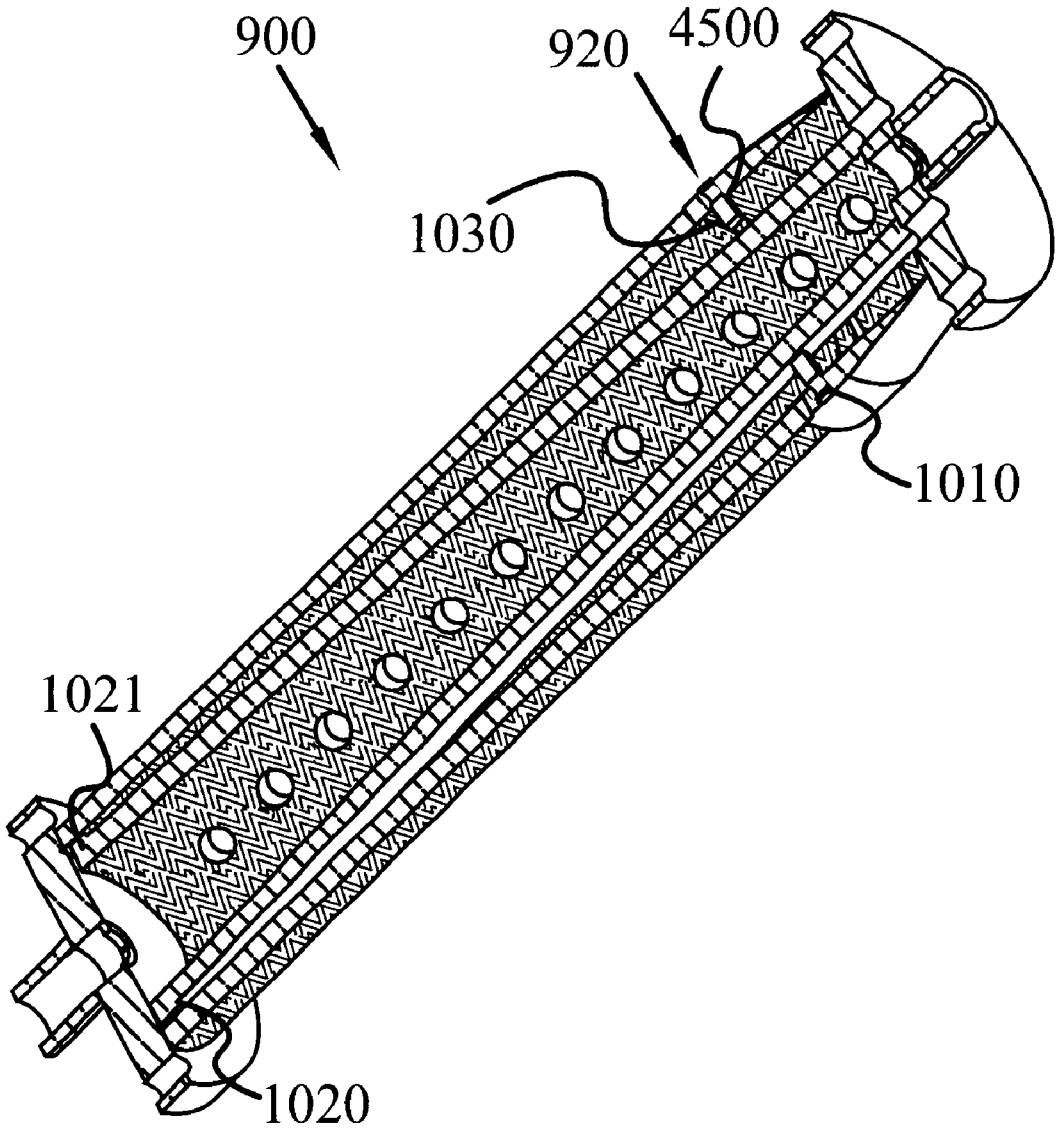
Figure 11:
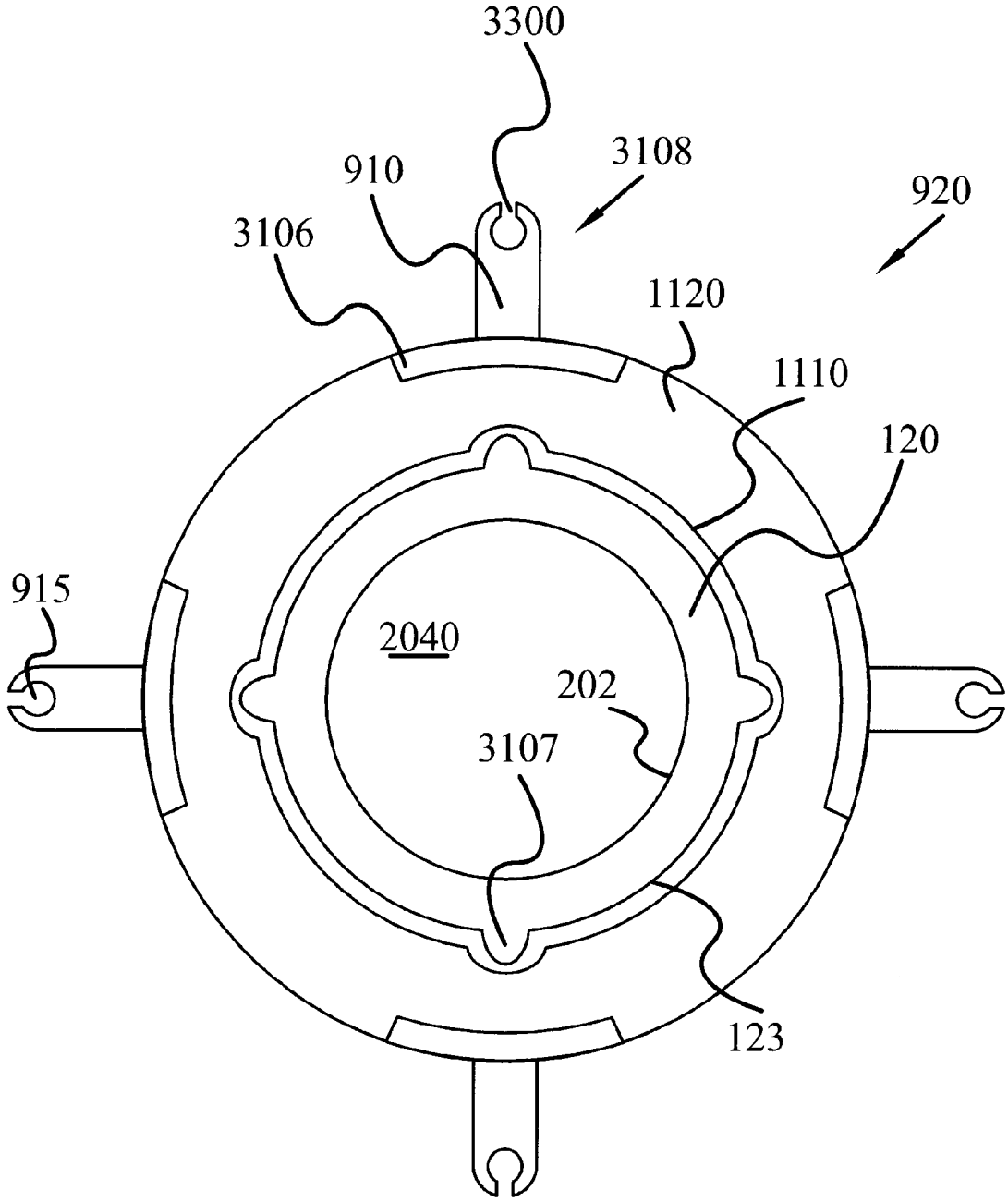
FIG. 11 is a front view of a retracting ring in accordance with a preferred embodiment of the present invention.
Figure 12:
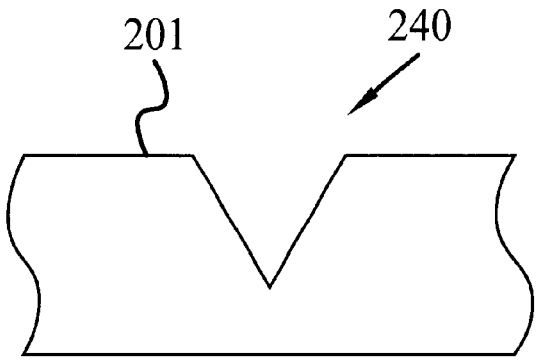
FIGS. 12 through 15 are depressions in accordance with preferred embodiments of the present invention.
Figure 13:
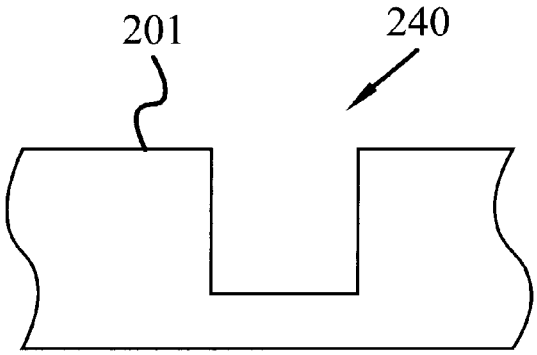
Figure 14:
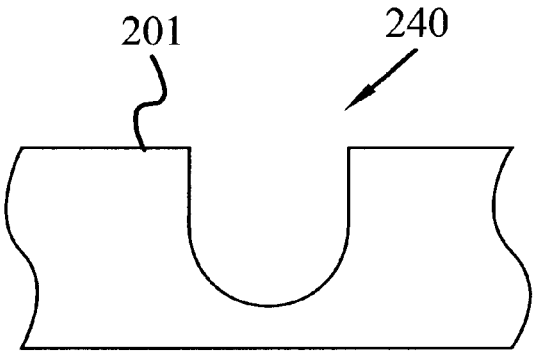

Turning now to FIGS. 9 through 11, these figures show the most preferred embodiment of the present invention. In this embodiment, the permanent wave rod 900 still comprises inner rod 120 and outer rod 130, and most of the elements of the previous embodiments are the same. Therefore, only the differences will be discussed herein. One difference is that end caps 112, 113 comprise bodies 2215, 2120, respectively, that are primarily circular, with only several sockets 151 at the top of each body. These bodies may also be used on previous embodiments, and a benefit of them is that they are smoother and are somewhat easier on fingers when rolling hair on the permanent wave rod.

In this embodiment, body 2115 has an additional set of sockets 3070 located in body 2115 closer to outer surface 123 of the inner rod 120. These sockets 3070 will be circular or cylindrical. Therefore, the preferred retainer used will be retainer 102 (see FIG. 1), and retainer 102 will in this embodiment preferably be made of a flexible plastic. The sockets 3070 will be sized to fit ends 2010 (see FIG. 1) of the retainer 102. This allows the retainer to quickly be inserted into sockets 3070, yet also allows the sockets 3070 to hold onto the retainer. It is preferred that the sockets 3070 be spaced above outer surface 123 of the inner rod 120 far enough to allow a sufficient quantity of hair to be placed underneath a retainer retained in sockets 3070. If the sockets 3070 are too close to the outer surface 123, then only a small amount of hair will be able to be placed on the inner rod's outer surface 123.

Outer surface 123 of inner rod 120 preferably has a flat portion 930 that is near outer end 137, a flat portion 950 that is near inner end 144, and a tapered portion 940 between these two portions. The tapered portion 940 preferably decreases in width from a first width (indicated by width or diameter 980) proximate the inner end 144 of the inner rod 120 to a second width (indicated by width or diameter 970) proximate the outer end 137 of the inner rod. Between the outer surface 123 of the inner rod 120 and the inner surface 201 of the outer rod 130, there is a retracting ring 920. Inner rod 120 preferably comprises lip 1021, near the very inner end 136 of the inner rod 120, that has a left edge 1020.

Retracting ring 920 (shown in large view in FIG. 11) comprises an O-ring 1120 having an inner surface 1110, and several coupling extension parts 3108 comprising bases 3106 and coupling extensions 910 that each comprise and define a socket 915. FIG. 11 shows a cross sectional view taken at location 3120. Sockets 915 are adapted for use with retainers 101, 102 (see FIG. 1). The retracting ring 920 has a right surface 1030 (made partially of a right surface 1030 of the O-ring 1120).

Inner surface 1110 contacts outer surface 123 of inner rod 120. The outer rod 130 has several coupling extension openings 1010. Each coupling extension opening 1010 is sized to allow a coupling extension 910 to pass through. The retracting ring resides between the outer surface 123 of the inner rod 120 and the inner surface 201 of the outer rod 130 and is situated such that each coupling extension 910 resides in one of the coupling extension openings 1010. In FIG. 10, the inner rod 120 is fully retracted, such that a substantial portion of the inner rod is within the outer rod. In this position, each coupling extension 910 resides below or very near the outer surface 124 of the outer rod 130. Because the retracting ring 920, and primarily the O-ring 1120, can shrink, the retracting ring shrinks to allow the coupling extensions 910 to fall beneath the outer rod's outer surface. It is beneficial if the O-ring 1120 is still somewhat tight around the outer surface of the inner rod, as this will provide a better seal. However, it should not be necessary, as the pressures used in the penning process are relatively low, and lip 1021 should provide a fairly good seal. FIG. 10 also shows a preferable groove 4500 that extends completely around the inner surface 201 of the outer rod 130. This groove 4500 allows helps to seat the retracting ring 920 and prevent slippage of the retracting ring. The groove 4500 is preferable, but not necessary, as the retracting ring 920 should fit relatively tightly between the inner and outer rods.

In FIG. 9, the inner rod 120 is fully extended, such that a substantial portion of the inner rod is outside of the outer rod, and each coupling extension 910 extends above the outer surface 124 of the outer rod. In this configuration, the outer surface 123 of the inner rod expands the retracting ring 920 (particularly O-ring 1120) and forces the coupling extensions 910 upward, through coupling extension openings 1010. Right side 1030 of the O-ring 1120 contacts left side 1020 of lip 1021 to provide a tight seal between the two rods.

In FIG. 11, it can be seen that the outer surface 123 of the inner rod preferably has humps 3107 at location 3120 (see FIG. 9), which is where the right side 1030 of the retracting ring abuts the left side 1020 of the lip 1021. These humps 3107 push up on the inner surface 1110 of the retracting ring 920 and help to force the coupling extensions 910 up through the coupling extension openings 1010 in the outer rod 130 (see FIG. 10). It should be noted that sockets 915 and coupling extensions 910 have a gap 3300. If desired, the gap may be eliminated so that the sockets 915 can be circular or cylindrical.

Retracting ring 920 preferably is made through a double injection molding process. In this process, the coupling extension parts 3108 (comprising bases 3106 and coupling extensions 910 that each comprise and define a socket 915) are mold injected. Coupling extension parts 3108 are preferably made of plastic. Next, these molded parts are placed in another mold and then the O-ring 1120 is mold injected. O-ring 1120 is preferably made of rubber or a plastic elastomer compound with good affinity for the plastic being used in the coupling extension parts. This process allows the elastomeric or rubber O-ring to become integral with the plastic of the coupling extension parts.

The benefit of the configuration of FIGS. 9 through 11 is that the full length of the outer rod 130 may be used to perm hair, when the inner rod is fully retracted. Also, the tapered portion 940 of the inner rod allows hair to have a different permed look after perming.

What has been shown is a variety of longitudinally adjustable permanent wave rods. Each permanent wave rod has an outer rod into which an inner rod fits. In one embodiment, an adjustable permanent wave rod has a number of sockets into which retainers fit. Alternatively, clips may be used to firmly hold hair between the clips and the inner and outer rods of the permanent wave rods. Preferably, the wave rods contain a distribution mechanism that distributes permanent solution towards the inside surface of the wave rods and also slows the solution down. Most preferably, the inner rod has a tapered surface along a substantial portion of its length and the outer rod has a tapered surface near the inner rod. Additionally, when the inner rod is tapered, a retractable ring is used that has extension couplings on it. The extension couplings are retracted beneath the outer surface of the outer rod when the inner rod is retracted and are fully extended and jut out from the outer surface of the outer rod when the inner rod is fully extended.

While the present invention has been particularly shown and described with reference to preferred embodiments thereof, it will be understood by those skilled in the art that various changes in form and details may be made therein without departing from the spirit and scope of the invention. Additionally, any methods are not necessarily in their recited order, unless an order is necessary.

What is claimed is:

1. A longitudinally adjustable permanent wave rod comprising:

an outer rod that defines a reservoir and that has at least one drain hole therethrough that is coupled to the reservoir of the outer rod, the outer rod having an outer surface about which hair may be wrapped, an inner end, and an outer end, the reservoir of the outer rod originating at the inner end of the outer rod and extending longitudinally at least a portion of a length of the outer rod;

wherein the outer rod further comprises an integral end cap proximate the outer end of the outer rod, the end cap comprising a first plurality of sockets, wherein the outer rod further comprises a second plurality of sockets proximate the inner end of the outer rod, wherein each of the plurality of first and second sockets is adapted to accept a retainer, and wherein a retainer engaged in one each of the first and second sockets would hold hair between the retainer and the outer surface of the outer rod; and an inner rod having an inner and outer end, the inner end of the inner rod received at the inner end of the outer rod and in the reservoir of the outer rod, the inner rod defining a reservoir, having at least one drain hole therethrough that is coupled to the inner reservoir of the inner rod, and having an outer surface about which hair may be wrapped, the inner rod longitudinally movable relative to the outer rod, the reservoir of the inner rod originating at the inner end of the inner rod and extending longitudinally at least a portion of a length of the inner rod.

2. The longitudinally adjustable permanent wave rod of claim 1 further comprising at least one retainer, the at least one retainer comprising two ends, wherein one end of the at least one retainer is held by one of the sockets on the inner end of the outer rod, and wherein the other end of the at least one retainer is held by one of the sockets on the outer end of the outer rod.

3. The longitudinally adjustable permanent wave rod of claim 1, wherein the integral end cap defines a passage therethrough that is coupled to the reservoir of the outer rod, the passage adapted to allow solution to pass into the reservoir of the outer rod, wherein the reservoir of the outer rod is defined by an inner surface of the outer rod, and wherein the integral end cap further comprises a distribution mechanism in the passage, the distribution mechanism coupled to the integral end cap and comprising a plurality of openings that distribute solution passing through the passage relatively evenly toward the inner surface of the outer rod.

4. The longitudinally adjustable permanent wave rod of claim 1, wherein the reservoir of the inner rod is defined by an inner surface of the inner rod, wherein the longitudinally adjustable permanent wave rod further comprises a removable end cap, the removable end cap adapted to be snugly received at the outer end of the inner rod by the inner surface of the inner rod, the removable end cap defining a passage therethrough.

5. The longitudinally adjustable permanent wave rod of claim 4 wherein the removable end cap further comprises a distribution mechanism in the passage, the distribution mechanism coupled to the removable end cap and comprising a plurality of openings that distribute solution passing through the respective passage relatively evenly toward the inner surface of the inner rod.

6. The longitudinally adjustable permanent wave rod of claim 5, wherein the removable end cap is configured to be snugly received at the outer end of the outer rod by the inner surface of the outer rod, and wherein the plurality of openings are configured to distribute solution passing through the respective passage relatively evenly toward the inner surface of the outer rod.

7. The longitudinally adjustable permanent wave rod of claim 1 wherein the outer surface of the inner rod comprises a tapered portion that decreases in width from a first width proximate the inner end of the inner rod to a second width proximate the outer end of the inner rod.

8. The longitudinally adjustable permanent wave rod of claim 1, wherein the reservoir of the inner rod is defined by an inner surface of the inner rod, wherein the reservoir of the outer rod is defined by an inner surface of the outer rod, and wherein each of the inner surfaces of the inner and outer rod comprise a plurality of depressions.

9. The longitudinally adjustable permanent wave rod of claim 1 wherein the outer surface of the outer rod comprises a tapered portion proximate the inner end of the outer rod, the tapered portion increasing in width from a first width at a first end of the tapered portion to a second width at a second end of the tapered portion, the first end of the tapered portion proximate the inner end of the outer rod, the second end of the tapered portion distal the inner end of the outer rod.

10. The longitudinally adjustable permanent wave rod of claim 1 wherein the reservoir of the outer rod is defined by an inner surface of the outer rod, the inner surface of the outer rod comprising at least one first engaging mechanism, wherein the outer surface of the inner rod comprises at least one second engaging mechanism, and wherein the first and second engaging mechanisms cooperate to lock fix the longitudinal location of the inner and outer rods.

11. The longitudinally adjustable permanent wave rod of claim 10 wherein the at least one first engaging mechanism comprises at least one receptacle and wherein the at least one second engaging mechanism comprises at least one detent mechanism, the at least one detent mechanism engaging one of the at least one receptacles.

12. The longitudinally adjustable permanent wave rod of claim 1 further comprising at least one clip, the at least one clip comprising a convex surface adapted to snugly fit onto the outer surface of the outer rod, whereby the at least one clip would hold hair between the outer surface of the outer rod and the convex surface.

13. The longitudinally adjustable permanent wave rod of claim 1 further comprising at least one clip, the at least one clip comprising a convex surface adapted to snugly fit onto the outer surface of the inner rod, whereby the at least one clip would hold hair between the outer surface of the inner rod and the convex surface.

14. A longitudinally adjustable permanent wave rod comprising:

an outer rod that defines a reservoir and that has at least one drain hole therethrough that is coupled to the reservoir of the outer rod, the outer rod having an outer surface about which hair may be wrapped, an inner end, and an outer end, the reservoir of the outer rod originating at the inner end of the outer rod and extending longitudinally at least a portion of a length of the outer rod; and an inner rod having an inner and outer end, the inner end of the inner rod received at the inner end of the outer rod and in the reservoir of the outer rod, the inner rod defining a reservoir, having at least one drain hole therethrough that is coupled to the inner reservoir of the inner rod, and having an outer surface about which hair may be wrapped, the inner rod longitudinally movable relative to the outer rod, the reservoir of the inner rod originating at the inner end of the inner rod and extending longitudinally at least a portion of a length of the inner rod;

wherein the inner rod further comprises an integral end cap proximate the outer end of the inner rod, the integral end cap of the inner rod comprising a first plurality of sockets, wherein the outer rod further comprises a second plurality of sockets proximate the inner end of the outer rod, wherein each of the plurality of first and second sockets is adapted to accept a retainer, and wherein a retainer engaged in one each of the first and second sockets would hold hair between the retainer and the outer surface of the inner rod.

15. The longitudinally adjustable permanent wave rod of claim 14 further comprising at least one retainer, the at least one retainer comprising two ends, wherein one end of the at least one retainer is held by one of the sockets on the inner end of the outer rod, and wherein the other end of the at least one retainer is held by one of the sockets on the outer end of the inner rod.

16. A longitudinally adjustable permanent wave rod comprising:

an outer rod that defines a reservoir and that has at least one drain hole therethrough that is coupled to the reservoir of the outer rod, the outer rod having an outer surface about which hair may be wrapped, an inner end, and an outer end, the reservoir of the outer rod originating at the inner end of the outer rod and extending longitudinally at least a portion of a length of the outer rod; and an inner rod having an inner and outer end, the inner end of the inner rod received at the inner end of the outer rod and in the reservoir of the outer rod, the inner rod defining a reservoir, having at least one drain hole therethrough that is coupled to the inner reservoir of the inner rod, and having an outer surface about which hair may be wrapped, the inner rod longitudinally movable relative to the outer rod, the reservoir of the inner rod originating at the inner end of the inner rod and extending longitudinally at least a portion of a length of the inner rod;

wherein the inner rod further comprises an integral end cap proximate the outer end of the inner rod, wherein the integral end cap of the inner rod defines a passage therethrough that is coupled to the reservoir of the inner rod, the passage allowing solution to pass into the reservoir of the inner rod, wherein the reservoir of the inner rod is defined by an inner surface of the inner rod, wherein the integral end cap of the inner rod further defines a distribution mechanism in the passage, the distribution mechanism comprising a plurality of openings that distribute solution passing through the passage relatively evenly toward the inner surface of the inner rod.

17. A longitudinally adjustable permanent wave rod comprising:

an outer rod that defines a reservoir and that has at least one drain hole therethrough that is coupled to the reservoir of the outer rod, the outer rod having an outer surface about which hair may be wrapped, an inner end, and an outer end, the reservoir of the outer rod originating at the inner end of the outer rod and extending longitudinally at least a portion of a length of the outer rod;

an inner rod having an inner and outer end, the inner end of the inner rod received at the inner end of the outer rod and in the reservoir of the outer rod, the inner rod defining a reservoir, having at least one drain hole therethrough that is coupled to the inner reservoir of the inner rod, and having an outer surface about which hair may be wrapped, the inner rod longitudinally movable relative to the outer rod, the reservoir of the inner rod originating at the inner end of the inner rod and extending longitudinally at least a portion of a length of the inner rod, and wherein the outer surface of the inner rod comprises a tapered portion that decreases in width from a first width proximate the inner end of the inner rod to a second width proximate the outer end of the inner rod; and a retracting ring, the retracting ring comprising an O-ring and a plurality of coupling extensions, each coupling extension comprising a socket and attached to a top surface of the O-ring, wherein the outer rod comprises one coupling extension opening per coupling extension, each coupling extension opening sized to allow a coupling extension to pass therethrough, wherein the retracting ring resides between the outer surface of the inner rod and the inner surface of the outer rod and is situated such that each coupling extension resides in one of the coupling extension openings, and wherein the outer surface of the inner rod contacts a bottom surface of the O-ring, and wherein the inner rod is able to be fully retracted such that a substantial portion of the inner rod is within the outer rod and able to be fully extended such that a substantial portion of the inner rod is outside of the outer rod, whereby each coupling extension extends above the outer surface of the outer rod when the inner rod is fully extended and resides below the outer surface of the outer rod when the inner rod is fully retracted.

18. The longitudinally adjustable wave rod of claim 12 wherein the outer surface of the inner rod comprises a plurality of humps near the inner end of the inner rod, each hump able to be positioned underneath one of the plurality of coupling extensions such that each hump pushes its respective coupling extension away from the outer surface of the inner rod.

19. A longitudinally adjustable permanent wave rod comprising:

an outer rod that defines a reservoir and that has at least one drain hole therethrough that is coupled to the reservoir of the outer rod, the outer rod having an outer surface about which hair may be wrapped, an inner end, and an outer end, the reservoir of the outer rod originating at the inner end of the outer rod and extending longitudinally at least a portion of a length of the outer rod;

an inner rod having an inner and outer end, the inner end of the inner rod received at the inner end of the outer rod and in the reservoir of the outer rod, the inner rod defining a reservoir, having at least one drain hole therethrough that is coupled to the inner reservoir of the inner rod, and having an outer surface about which hair may be wrapped, the inner rod longitudinally movable relative to the outer rod, the reservoir of the inner rod originating at the inner end of the inner rod and extending longitudinally at least a portion of a length of the inner rod;

wherein the reservoir of the outer rod is defined by an inner surface of the outer rod, wherein the inner surface of the outer rod comprises at least one groove that is perpendicular to a longitudinal axis of the outer rod, wherein the outer surface of the inner rod comprises at least one O-ring that is perpendicular to a longitudinal axis of the inner rod, the at least one O-ring engaging one of the at least one grooves, and wherein the at least one groove and the at least one O-ring cooperate to lock fix the longitudinal location of the inner and outer rods.

20. A longitudinally adjustable permanent wave rod comprising:

an outer rod that defines a reservoir and that has at least one drain hole therethrough that is coupled to the reservoir of the outer rod, the outer rod having an outer surface about which hair may be wrapped, an inner end, and an outer end, the reservoir of the outer rod originating at the inner end of the outer rod and extending longitudinally at least a portion of a length of the outer rod;

an inner rod having an inner and outer end, the inner end of the inner rod received at the inner end of the outer rod and in the reservoir of the outer rod, the inner rod defining a reservoir, having at least one drain hole therethrough that is coupled to the inner reservoir of the inner rod, and having an outer surface about which hair may be wrapped, the inner rod longitudinally movable relative to the outer rod, the reservoir of the inner rod originating at the inner end of the inner rod and extending longitudinally at least a portion of a length of the inner rod;

wherein the reservoir of the outer rod is defined by an inner surface of the outer rod, wherein the inner surface of the outer rod comprises a plurality of female threads, wherein the outer surface of the inner rod comprises a plurality of male threads, at least a portion of the male threads engaging at least a portion of the female threads, and wherein the plurality of female threads and the plurality of male threads cooperate to lock fix the longitudinal location of the inner and outer rods.

* * * * *